US010084252B1

(12) United States Patent
Ju et al.

(10) Patent No.: US 10,084,252 B1
(45) Date of Patent: Sep. 25, 2018

(54) ELECTRICAL CONNECTOR

(71) Applicant: LOTES CO., LTD, Keelung (TW)

(72) Inventors: Ted Ju, Keelung (TW); Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/834,457

(22) Filed: Dec. 7, 2017

(30) Foreign Application Priority Data

Jul. 24, 2017 (CN) ..... 2017 1 0606840
Jul. 27, 2017 (CN) ..... 2017 1 0623202

(51) Int. Cl.
*H01R 12/70* (2011.01)
*H01R 4/02* (2006.01)
*H01R 13/24* (2006.01)
*H01R 12/71* (2011.01)

(52) U.S. Cl.
CPC ..... *H01R 12/707* (2013.01); *H01R 4/027* (2013.01); *H01R 4/028* (2013.01); *H01R 12/712* (2013.01); *H01R 13/2442* (2013.01)

(58) Field of Classification Search
None
See application file for complete search history.

(56) References Cited

U.S. PATENT DOCUMENTS 6,116,923 A * 9/2000 Szu ..... H05K 3/3426 439/70
6,155,845 A * 12/2000 Lin ..... H01R 4/028 439/78
6,179,631 B1 * 1/2001 Downes ..... H01R 43/0256 228/246
6,217,348 B1 * 4/2001 Lin ..... H01R 12/57 257/738
6,352,437 B1 * 3/2002 Tate ..... H01R 4/02 439/83
6,471,526 B1 * 10/2002 Harper, Jr. ..... H05K 7/1061 439/66

(Continued)

FOREIGN PATENT DOCUMENTS

CN 2351844 Y 12/1999
CN 1398018 A 2/2003

(Continued)

*Primary Examiner* — Ross Gushi
(74) *Attorney, Agent, or Firm* — Locke Lord LLP; Tim Tingkang Xia, Esq.

(57) ABSTRACT

An electrical connector includes: an insulating body; multiple terminals, each terminal having a contact portion and at least one clamping portion forming a clamping space; and multiple solder posts, each being correspondingly placed in the clamping space. The solder post has a foundation post and a protruding portion extending upward from the foundation post. The clamping portion clamps the foundation post in the clamping space. A width of the protruding portion is smaller than a width of the foundation post. The foundation post is cylindrical. A height of the solder post is greater than a diameter of the foundation post. The solder posts are arranged more densely on the insulating body. When the electrical connector and a circuit board are together placed into a reflow oven, hot gas flows around the protruding portion more easily, and a contact area between the hot gas and the protruding portion is larger.

14 Claims, 6 Drawing Sheets

(56) References Cited

U.S. PATENT DOCUMENTS 6,501,665 B1 * 12/2002 Ted ..... H05K 3/3426 174/257
6,530,788 B1 * 3/2003 Ju ..... H01R 12/57 439/83
6,533,590 B1 * 3/2003 Lee ..... H01R 4/027 439/83
6,692,265 B2 * 2/2004 Kung ..... H01R 12/57 439/68
6,769,924 B1 * 8/2004 Korsunsky ..... H01R 4/028 29/854
6,783,375 B2 * 8/2004 He ..... H01R 43/0256 439/342
6,969,286 B1 * 11/2005 Mongold ..... H01R 12/57 439/874
6,997,757 B2 * 2/2006 Roshardt ..... H01R 43/0235 439/751
7,029,292 B2 * 4/2006 Grabbe ..... H01R 12/57 439/83
7,771,244 B1 * 8/2010 Ju ..... H01R 4/022 439/342
7,791,443 B1 * 9/2010 Ju ..... H01R 12/52 336/107
7,837,522 B1 * 11/2010 Hoover ..... H01R 12/57 29/843
7,909,621 B1 * 3/2011 Terhune, IV ..... H01R 12/57 439/83
8,047,864 B1 * 11/2011 Ju ..... H01R 4/58 439/342
8,052,433 B2 * 11/2011 Yeh ..... H01R 13/24 439/83
8,052,436 B1 * 11/2011 Ju ..... H01R 12/57 439/342
8,052,454 B2 * 11/2011 Polnyi ..... H01R 12/57 439/342
8,147,256 B2 * 4/2012 Jin ..... H01R 12/52 439/83
8,192,206 B1 * 6/2012 Ju ..... H01R 12/57 439/66
8,202,101 B2 * 6/2012 Zimmerman ..... H01R 4/02 439/70
8,246,360 B1 * 8/2012 Tsai ..... H01R 12/55 439/66
8,708,716 B1 * 4/2014 Ho ..... H01R 12/714 439/83
9,419,354 B2 * 8/2016 Mongold ..... H01R 12/57
9,806,444 B1 * 10/2017 Ju ..... H01R 12/585
9,954,312 B1 * 4/2018 Ju ..... H01R 12/707
2003/0013330 A1 * 1/2003 Takeuchi ..... H01R 12/57 439/83
2003/0068916 A1 * 4/2003 Ju ..... H05K 3/3426 439/342
2003/0114028 A1 * 6/2003 Ohkita ..... H01R 12/57 439/83
2003/0114029 A1 * 6/2003 Lee ..... H01R 4/028 439/83
2003/0203660 A1 * 10/2003 Kassa ..... H05K 3/3426 439/65
2004/0253852 A1 * 12/2004 Regnier ..... H05K 3/3426 439/83
2005/0020108 A1 * 1/2005 Ju ..... H01R 4/028 439/83
2005/0059276 A1 * 3/2005 Lee ..... H01R 43/0235 439/83
2005/0079745 A1 * 4/2005 Ju ..... H01R 4/028 439/67
2005/0287836 A1 * 12/2005 Ju ..... H01R 43/0235 439/71
2006/0094268 A1 * 5/2006 Hao ..... H01R 12/57 439/83
2006/0258190 A1 * 11/2006 Chen ..... H05K 3/3426 439/83
2006/0258191 A1 * 11/2006 Chen ..... H05K 3/3426 439/83
2008/0108255 A1 * 5/2008 Peloza ..... B23K 1/0008 439/876
2009/0088016 A1 * 4/2009 Liao ..... H05K 3/3426 439/357
2010/0003868 A1 * 1/2010 Wu ..... H01R 13/11 439/884
2010/0216322 A1 * 8/2010 Fan ..... H01R 12/58 439/83
2010/0236815 A1 * 9/2010 Seidler ..... B23K 35/0244 174/126.1
2010/0297866 A1 * 11/2010 Ju ..... H01R 13/112 439/342
2011/0008979 A1 * 1/2011 Yeh ..... H01R 12/57 439/83
2011/0053426 A1 * 3/2011 Cheng ..... H01R 12/57 439/660
2011/0189898 A1 * 8/2011 Ju ..... H01R 24/00 439/660
2011/0318966 A1 * 12/2011 Huo ..... H01R 12/716 439/626
2012/0028502 A1 * 2/2012 Yeh ..... H01R 12/57 439/626
2012/0058691 A1 * 3/2012 Ju ..... H01R 13/111 439/751
2012/0129363 A1 * 5/2012 Wang ..... H01R 12/57 439/83
2012/0156939 A1 * 6/2012 Ju ..... H01R 12/7082 439/660
2012/0171897 A1 * 7/2012 Ju ..... H01R 13/41 439/607.01
2012/0178298 A1 * 7/2012 Jin ..... H01R 12/714 439/626
2012/0178306 A1 * 7/2012 Ju ..... H01R 12/57 439/660
2012/0202384 A1 * 8/2012 Liaw ..... H01R 12/57 439/626
2012/0225586 A1 * 9/2012 Tsai ..... H01R 13/2442 439/626
2012/0238137 A1 * 9/2012 Cai ..... H01R 12/57 439/607.28
2012/0252274 A1 * 10/2012 Ju ..... H01R 12/716 439/626
2013/0045639 A1 * 2/2013 Zhang ..... H01R 12/57 439/660
2013/0095698 A1 * 4/2013 Ju ..... H01R 12/714 439/626
2013/0295797 A1 * 11/2013 Hoffmeyer ..... H01R 12/58 439/884
2014/0030925 A1 * 1/2014 Terhune, IV ..... H01R 12/714 439/626
2014/0174821 A1 * 6/2014 Pao ..... H01R 43/02 174/75 R
2014/0174823 A1 * 6/2014 Pao ..... H01R 12/57 174/84 C
2014/0242817 A1 * 8/2014 Mongold ..... H01R 13/428 439/83
2015/0171540 A1 * 6/2015 Huang ..... H01R 12/52 439/722
2016/0072198 A1 * 3/2016 Tsai ..... H01R 4/027 439/877

FOREIGN PATENT DOCUMENTS

| | | | |
|---|---|---|---|
| CN | 201104329 | Y | 8/2008 |
| CN | 201374425 | Y | 12/2009 |
| CN | 201937059 | U | 8/2011 |
| CN | 102456968 | A | 5/2012 |
| CN | 203056199 | U | 7/2013 |
| TW | 201342726 | A | 10/2013 |
| TW | 201419678 | A | 5/2014 |

* cited by examiner

ELECTRICAL CONNECTOR

CROSS-REFERENCE TO RELATED PATENT APPLICATION

This application claims priority to and the benefit of, pursuant to 35 U.S.C. § 119(a), Patent Application Serial No. CN201710606840.6 filed in P.R. China on Jul. 24, 2017, and Patent Application Serial No. CN201710623202.5 filed in China on Jul. 27, 2017. The entire contents of the above-identified applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector used for electrically connecting a chip module to a circuit board.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An electrical connector frequently used in the industry has multiple terminals. Each of the terminals has a contact portion, and the contact portion is in electrical contact with a chip module upward. Each of the terminals has a soldering portion, and the soldering portion is provided with a clamping portion. A solder post is clamped by means of the clamping portion, and the solder post is fused at a high temperature, so that the solder post is in electrical contact with a circuit board downward, so as to implement an electrical conduction between the terminals and the circuit board, and facilitate the electrical connection between the chip module and the circuit board.

However, the foregoing electrical connector has the following defects: the solder post is cylindrical, and has an equal diameter at its top surface and bottom surface. When being in the reflow oven, hot gas circulates in a space defined by the top surface of the solder post and the insulating body, and the space is small to cause poor circulation of the hot gas. Thus, the solder post has a relatively long melting time and an unbalanced melting temperature.

Therefore, a heretofore unaddressed need to design an improved electrical connector exists in the art to address the aforementioned deficiencies and inadequacies.

SUMMARY

In view of the problem addressed in the background technology, an objective of the present invention is to provide an electrical connector in which a protruding portion is disposed on a solder post, and the protruding portion is higher than a clamping portion, thereby facilitating gas circulation during soldering, and then ensuring a soldering effect. To achieve the foregoing objective, the present invention adopts the following technical means.

An electrical connector includes: an insulating body, provided with a plurality of accommodating holes vertically running through the insulating body; a plurality of terminals, respectively and correspondingly accommodated in the accommodating holes, wherein each of the terminals has a main body portion, a contact portion extending upward from the main body portion, and a soldering portion extending downward from the main body portion, the soldering portion has at least one clamping portion, and the at least one clamping portion forms a clamping space; and a plurality of solder posts, each being correspondingly placed in the clamping space of a corresponding one of the terminals, wherein each of the solder posts has a foundation post and a protruding portion extending upward from the foundation post, the at least one clamping portion clamps the foundation post in the clamping space, a width of the protruding portion is smaller than a width of the foundation post, the protruding portion is higher than the clamping portion, the foundation post is cylindrical, and a height of each of the solder posts is greater than a diameter of the foundation post.

In certain embodiments, the soldering portion has a connecting portion, two clamping portions are formed by extending respectively and symmetrically from two sides of the connecting portion, the connecting portion and the two clamping portions jointly form the clamping space, the two clamping portions clamp the foundation post, and the connecting portion abuts the foundation post.

In certain embodiments, the connecting portion is vertically disposed.

In certain embodiments, a side of the clamping space away from the connecting portion is provided with an opening, and the opening is located between the two clamping portions and separates the two clamping portions.

In certain embodiments, an outer side of the solder post is arc-shaped, an inner wall of the clamping space is correspondingly arc-shaped, and the solder post is in laminated contact with the inner wall of the clamping space.

In certain embodiments, the protruding portion is provided to gradually shrink upward from the foundation post.

In certain embodiments, a horizontal cross-section of the protruding portion is circular-shaped.

In certain embodiments, a top of the protruding portion is an arc surface.

In certain embodiments, the foundation post has a bottom surface horizontally disposed and extending downward beyond the accommodating hole, and the bottom surface is configured to be in contact with a circuit board.

In certain embodiments, a distance between the bottom surface and the at least one clamping portion is greater than 0.15 cm.

In certain embodiments, a siphon-proof structure is provided at a position of the main body portion close to the soldering portion.

In certain embodiments, the siphon-proof structure is at least partially lower than the protruding portion.

In certain embodiments, a stopping portion is disposed in the accommodating hole, and the stopping portion is located above the protruding portion.

In certain embodiments, the solder post is made of tin.

Compared with the prior art, the present invention has the following beneficial effects:

The solder post has the foundation post and the protruding portion extending upward from the foundation post. Each of the terminals has the clamping portion, and the clamping portion forms the clamping space used to place the solder post. The height of the solder post is greater than the diameter of the foundation post, and compared with the solder post that has a same volume and whose height is not greater than the diameter of the solder post, a cross-section of the former in a horizontal direction is smaller, and therefore the solder posts are arranged more densely on the insulating body.

After assembly of the electrical connector is complete, the electrical connector needs to be soldered to a circuit board. Therefore, the assembled electrical connector and the circuit board are together placed into a reflow oven. The electrical connector is located above the circuit board, and the solder posts respectively correspond to multiple solder pads on the circuit board. When the reflow oven performs heating, hot gas performs heating from above and laterally. Because the protruding portion is higher than the clamping portion and the width of the protruding portion is smaller than the width of the foundation post, compared with the solder posts that are all cylindrical, hot gas flows around the protruding portion more easily, and a contact area between the hot gas and the protruding portion is larger, so as to ensure good circulation performance of the hot gas in the reflow oven, and the solder posts have a shortened melting time and a relatively balanced melting temperature, thereby ensuring a soldering effect.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
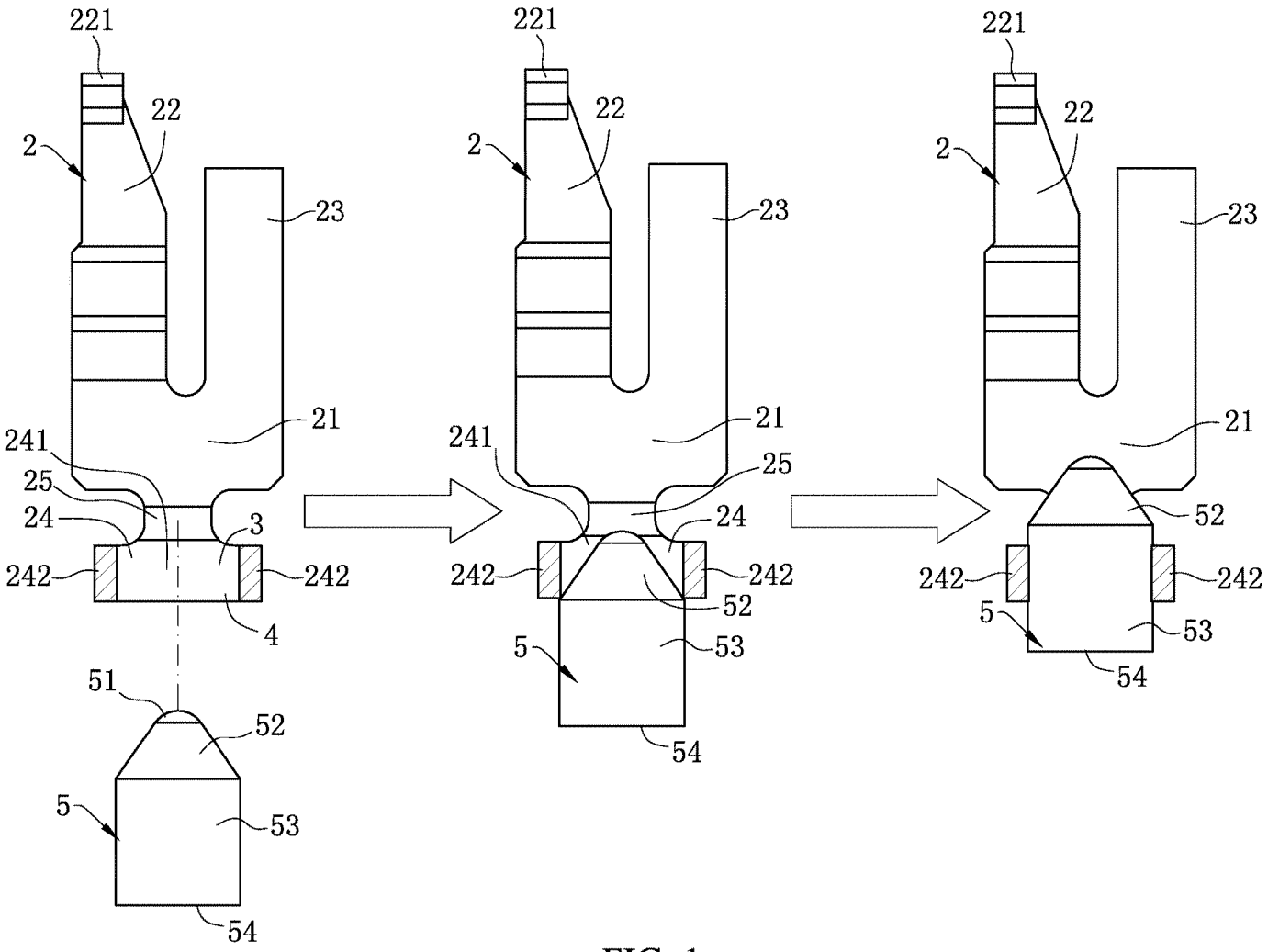
FIG. 1 is a schematic view of a process in which a solder post enters a terminal in an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to a method for manufacturing an electrical connector.

Figure 3:
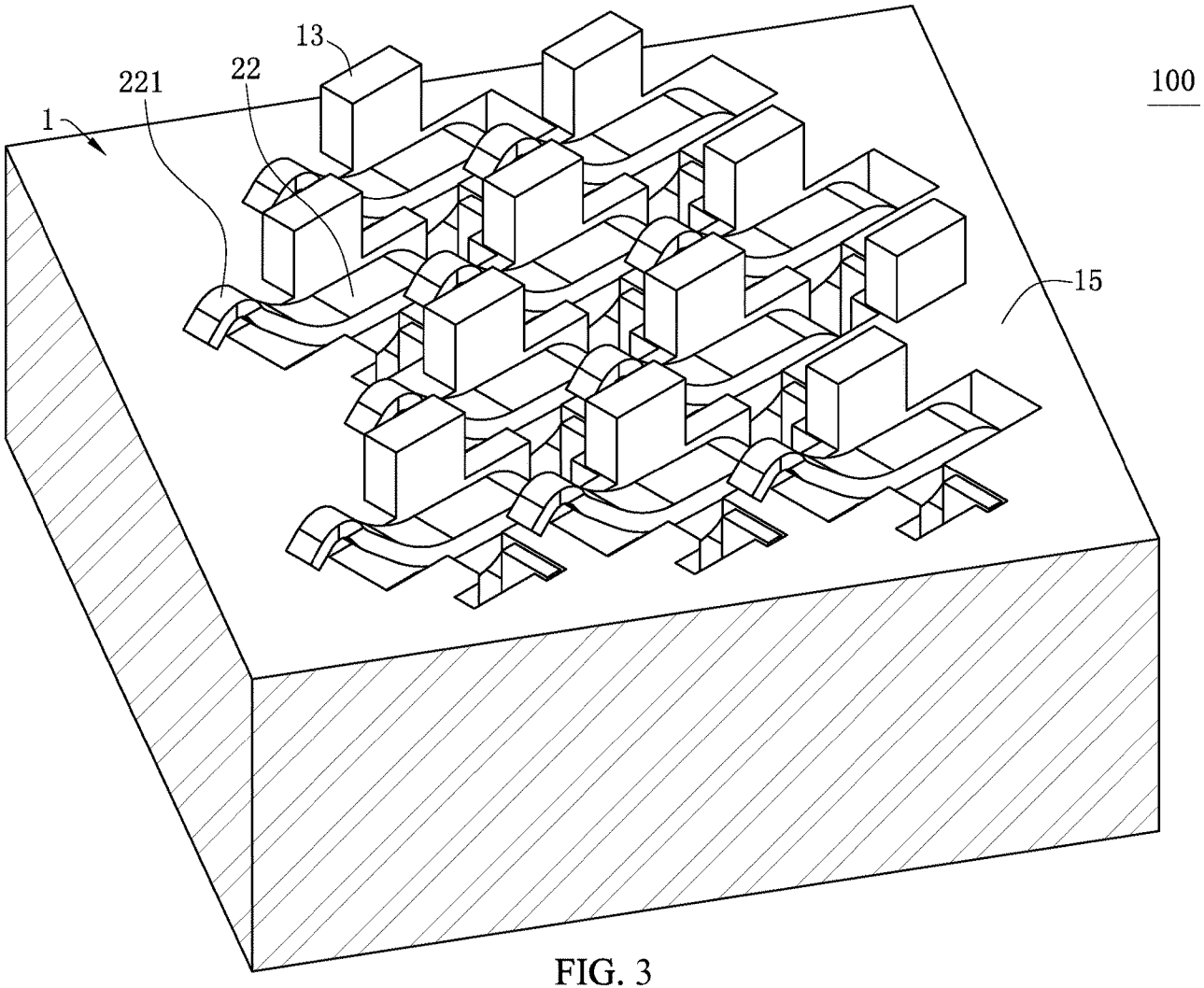
FIG. 3 is a local perspective assembly view of an electrical connector according to certain embodiments of the present invention.
Figure 4:
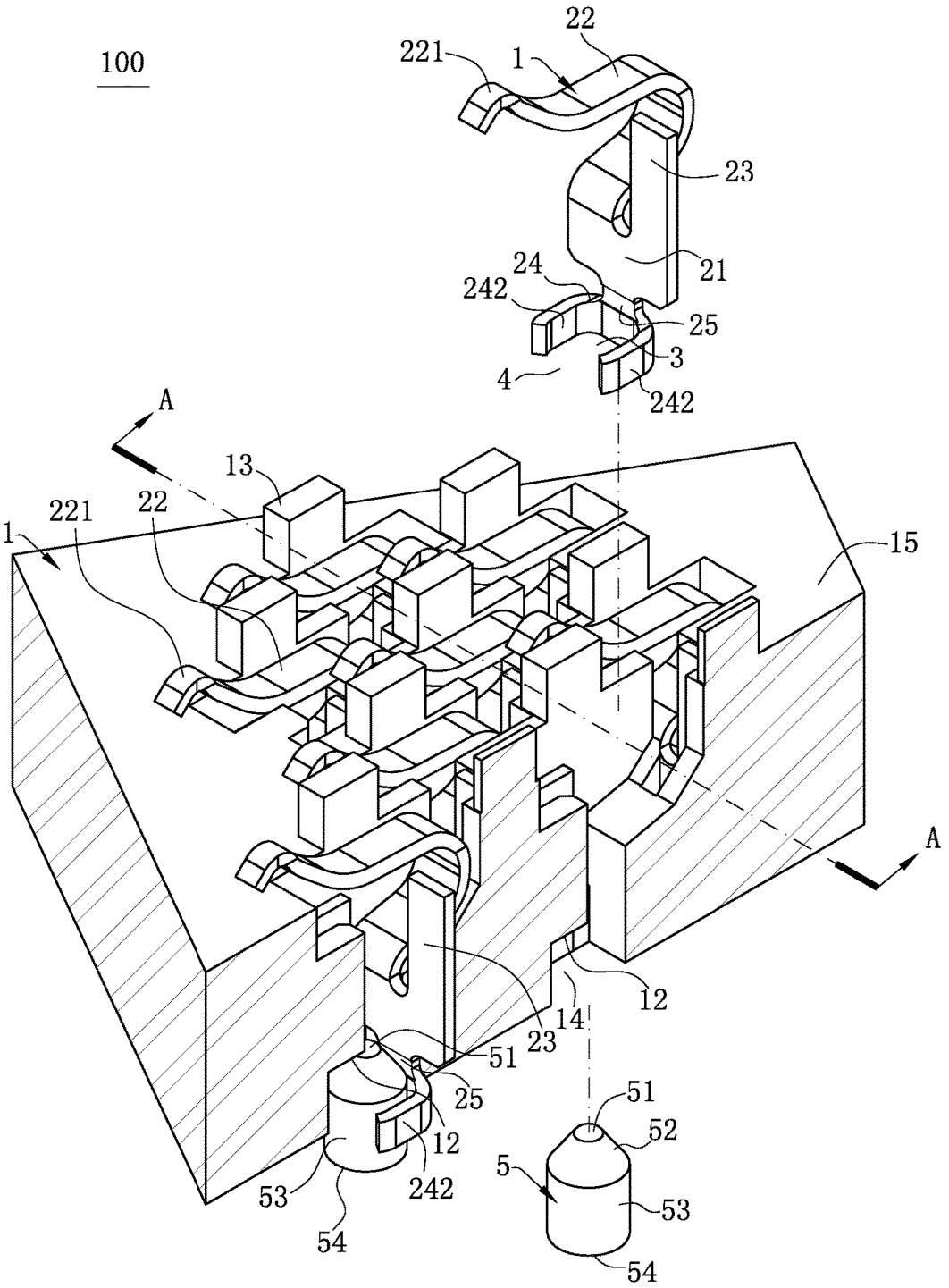
FIG. 4 is a local exploded sectional view of FIG. 3.
Figure 5:
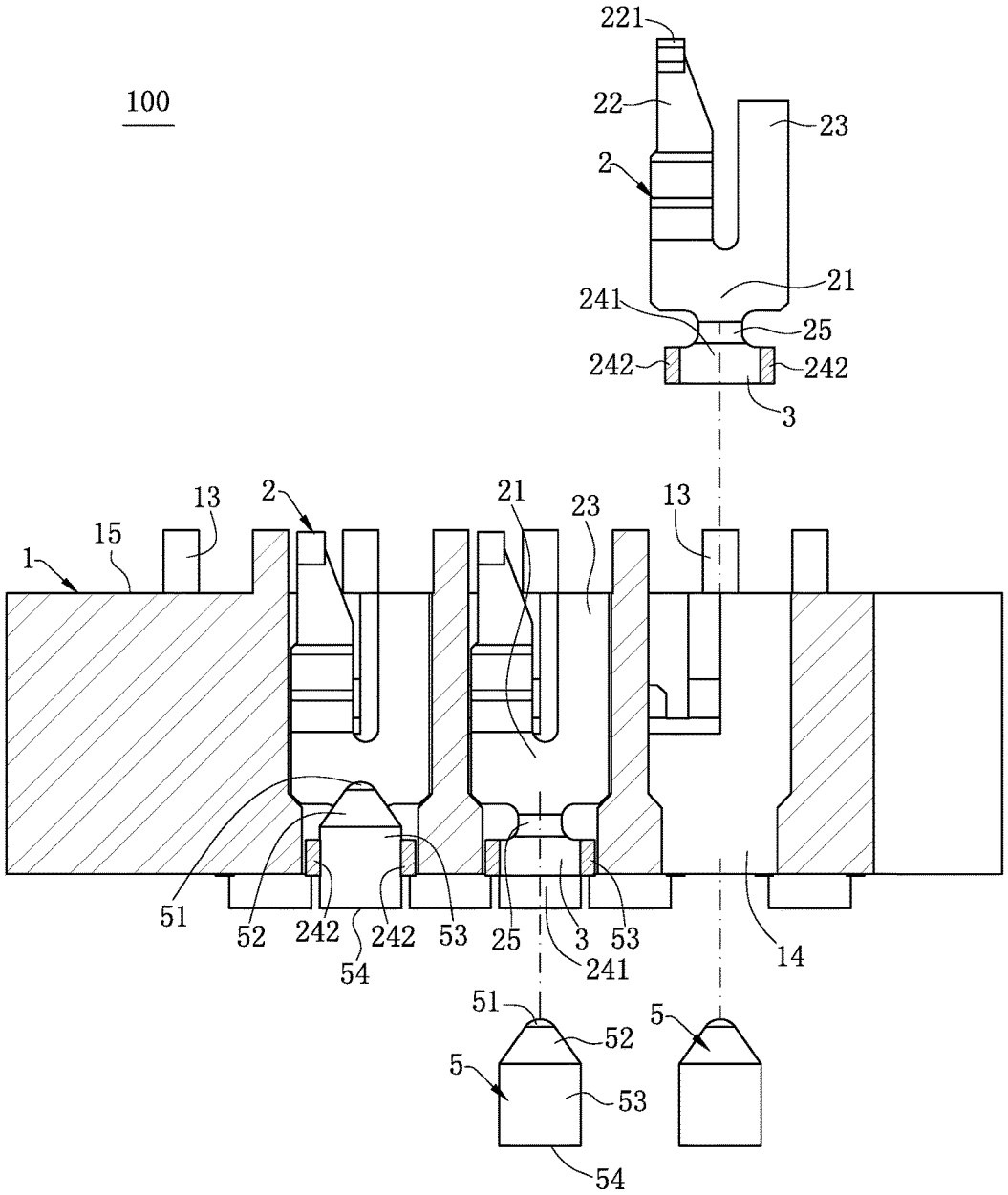
FIG. 5 is a sectional view along a direction A-A in FIG. 4.

As shown in FIG. 3 and FIG. 4, the electrical connector 100 according to certain embodiments of the present invention includes an insulating body 1, multiple terminals 2, and multiple solder posts 5.

Figure 6:
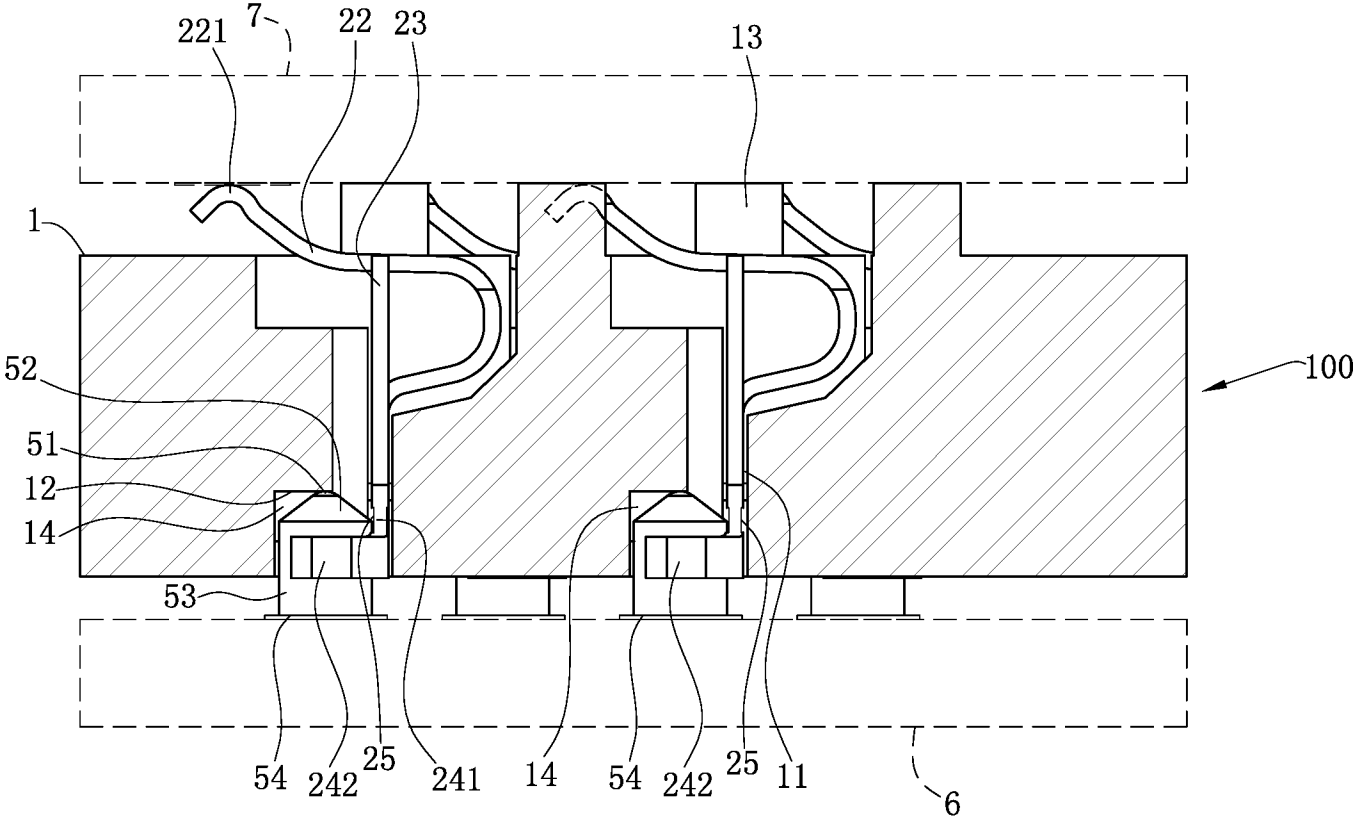
FIG. 6 is a schematic view of the assembled electrical connector in FIG. 4 matching with a circuit board and a chip module.

As shown in FIGS. 4 and 6, the insulating body 1 is provided with multiple accommodating holes 14 vertically running through the insulating body 1, and the accommodating holes 14 are used to accommodate the terminals 2 and the solder posts 5. The insulating body 1 has an upper surface 15, and the upper surface 15 is provided with multiple protruding blocks 13. Each of the accommodating holes 14 is provided with a stopping portion 12, and the stopping portion 12 stops the solder post 5 from moving up and down. A groove 11 is disposed in each of the accommodating holes 14.

Figure 2:
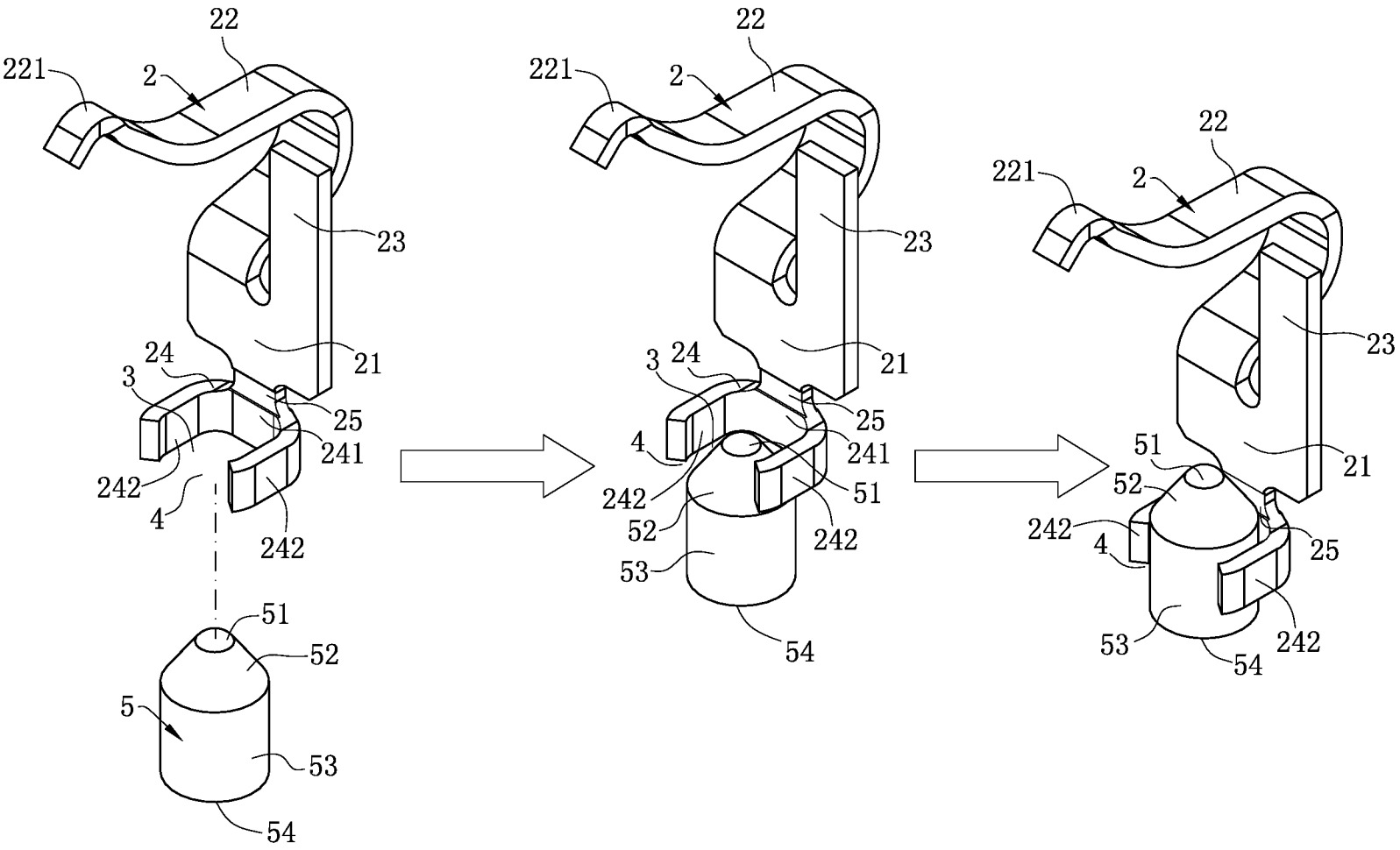
FIG. 2 is a perspective view of a process in which a solder post enters a terminal in an electrical connector according to certain embodiments of the present invention.

As shown in FIG. 2 and FIG. 6, each of the terminals 2 has a main body portion 21, and the main body portion 21 has an extending portion 23 extending upward and an elastic arm 22 extends slantwise. A free end of the elastic arm 22 has a contact portion 221 electrically connected to a chip module 7, and the elastic arm 22 is provided with the contact portion 221 extending slantwise therefrom, so that the elastic arm 22 is not easily fatigued, and contact between the terminal 2 and the chip module 7 is more stable. The extending portion 23 and the elastic arm 22 are disposed adjacent to each other, and a gap is provided between the extending portion 23 and the elastic arm 22. The extending portion 23 is accommodated in the groove 11, and the protruding block 13 is located between two the elastic arms 22, and is not lower than the contact portion 221. It can be seen that the protruding block 13 may stop contact between the two elastic arms 22, and the terminal 2 is limited in the accommodating hole 14, so as to prevent the electrical connector 100 from short-circuiting by misplacement between multiple terminals 2.

As shown in FIG. 2 and FIG. 6, a soldering portion 24 extends downward from the main body portion 21. The soldering portion 24 has a connecting portion 241 that is vertically disposed. Two clamping portions 242 are formed by respectively and symmetrical extending from two sides of the connecting portion 241, and the two clamping portions 242 clamp the solder post 5. A siphon-proof structure 25 is provided at a position of the main body portion 21 close to the soldering portion 24. When the soldering portion 24 is soldered onto the circuit board 6, the siphon-proof structure 25 may be provided for the solder to permeate therein, so that the solder climbing upward in a direction toward the soldering portion 24 is reduced, so as to play an anti-siphon role. Moreover, the solder remaining on the soldering portion 24 is relatively much, so as to prevent an empty soldering phenomenon. The connecting portion 241 and the two clamping portions 242 jointly form a clamping space 3. A side of the clamping space 3 away from the connecting portion 241 is provided with an opening 4, and the opening 4 is located between the two clamping portions 242 and separates the two clamping portions 242.

As shown in FIG. 1, the solder post 5 has a foundation post 53 and a protruding portion 52 extending upward from the foundation post 53. The clamping portions 242 clamp the foundation post 53 in the clamping space 3. The two clamping portions 242 clamp the foundation post 53 and are located at a two-third location of the foundation post 53. The connecting portion 241 abuts the foundation post 53, and the siphon-proof structure 25 is at least partially lower than the protruding portion 52. In other embodiments, the siphon-proof structure 25 may be not lower than the protruding portion 52. The foundation post 53 is cylindrical, that is, an outer side of the solder post 5 is arc-shaped. Correspondingly, an inner wall of the clamping space 3 is arc-shaped, and the foundation post 53 and the inner wall of the clamping space 3 are in laminated contact, so that the contact area is large and the contact is tighter. Therefore, better clamping may be implemented. The protruding portion 52 is provided to gradually shrink upward from the foundation post 53, that is, the width of the protruding portion 52 is smaller than the width of the foundation post 53, and a horizontal cross-section of the protruding portion 52 is circular-shaped. The protruding portion 52 has a top 51, and the protruding portion 52 has an arc surface, so as to prevent the electrical connector 100 from short-circuiting by dropping of a tin block caused by breaking of the top 51 of the solder post 5 due to collision. In other embodiments, the protruding portion 52 may be pyramidal, arc-shaped or semi-spherical. The solder post 5 is made of tin, or may be made of another solder whose soldering property is good.

As shown in FIG. 6, the stopping portion 12 is located above the protruding portion 52 and the protruding portion 52 abuts the stopping portion 12 upward, so as to prevent the solder post 5 from being separated from the clamping space 3. The foundation post 53 has a horizontal bottom surface 54, and extends downward out of the accommodating hole 14, and the bottom surface 54 is used to be in contact with the circuit board 6. Therefore, the contact area between the solder post 5 and the circuit board 6 is larger, the contact is tighter, and the soldering effect is better. The distance between the bottom surface 54 and the clamping portion 242 is greater than 0.15 cm, while the distance between the bottom surface 54 of a solder ball having a same tin amount and the clamping portion 242 can be only 0.15 cm, so as to avoid empty soldering, and ensure the soldering effect. The height of the solder post 5 is greater than the diameter of the foundation post 53, and compared with the solder post 5 that has a same volume and whose height is not greater than the diameter of the solder post 5, a cross-section of the former in a horizontal direction is smaller. Therefore, the solder posts 5 are arranged more densely on the insulating body 1.

As shown in FIG. 6, after assembly of the electrical connector 100 is complete, the electrical connector 100 needs to be soldered to a circuit board 6. Therefore, the assembled electrical connector 100 and the circuit board 6 are together placed into a reflow oven (not shown). The electrical connector 100 is located above the circuit board 6, and the solder posts 5 respectively correspond to multiple solder pads on the circuit board 6. When the reflow oven performs heating, because the bottom surface 54 and the circuit board 6 are in plane contact, hot gas can only perform heating from above and laterally. Because the protruding portion 52 is higher than the clamping portion 242 and the width of the protruding portion 52 is less than the width of the foundation post 53, compared with the solder posts 5 that are all cylindrical, hot gas flows around the protruding portion 52 more easily, and a contact area between the hot gas and the protruding portion 52 is larger, so as to ensure good circulation performance of the hot gas in the reflow oven, and the solder posts 5 have a shortened melting time and a relatively balanced melting temperature, thereby ensuring a soldering effect. Moreover, comparing the solder post 5 with a cylindrical tin post, the protruding portion 52 plays a role of guiding the solder post 5 to squeeze into the clamping space 3 from bottom up, that is, the protruding portion 52 opens the clamping portion 242. Compared with a case in which the clamping portion 242 clamps a solder ball, a clamping force of the clamping portion 242 for the solder post 5 is larger, and the clamping effect is better.

To sum up, the electrical connector 100 according to certain embodiments of the present invention has the following beneficial effects:

(1) The solder post 5 has the cylindrical foundation post 53 and the protruding portion 52 provided to gradually shrink upward from the foundation post 53, and the protruding portion 52 is higher than the clamping portion 242. When the electrical connector 100 is connected to a contact point on the circuit board 6 and the solder post 5 is heated in the reflow oven, because the bottom surface 54 and the circuit board 6 are in plane contact, hot gas in the reflow oven can only enter from the protruding portion 52 above or laterally and circulate in the space defined by the protruding portion 52 and the insulating body 1, and the space is larger than the space defined by the cylindrical solder post 5 and the insulating body 1. Thus, the circulation space of the hot gas in the reflow oven increases, circulation performance of the hot gas is improved, and the solder posts 5 have a shortened melting time and a relatively balanced melting temperature, thereby ensuring a soldering effect. Moreover, comparing the solder post 5 with a cylindrical tin post, the protruding portion 52 plays a role of guiding the solder post 5 to squeeze into the clamping space 3 from bottom up, that is, the protruding portion 52 opens the clamping portion 242. Compared with a case in which the clamping portion 242 clamps a solder ball, a clamping force of the clamping portion 242 for the solder post 5 is larger, and the clamping effect is better.

(2) The protruding portion 52 has the top 51, and the protruding portion 52 has an arc surface, so as to prevent the electrical connector 100 from short-circuiting by dropping of a tin block caused by breaking of the top 51 of the solder post 5 due to collision.

(3) An outer side of the solder post 5 is arc-shaped. Correspondingly, an inner wall of the clamping space 3 is arc-shaped, and the foundation post 53 and the inner wall of the clamping space 3 are in laminated contact, so that the contact area is large and the contact is tighter. Therefore, better clamping may be implemented.

(4) The foundation post 53 has a horizontal bottom surface 54, and extends downward out of the accommodating hole 14. The bottom surface 54 is used to be in contact with the circuit board 6. Therefore, the contact area between the solder post 5 and the circuit board 6 is larger, the contact is tighter, and the soldering effect is better. The distance between the bottom surface 54 and the clamping portion 242 is greater than 0.15 cm, while the distance between the bottom surface 54 of a solder ball having a same tin amount and the clamping portion 242 can be only 0.15 cm, so as to avoid empty soldering, and ensure the soldering effect. The height of the solder post 5 is greater than the diameter of the foundation post 53, and compared with the solder post 5 that has a same volume and whose height is not greater than the diameter of the solder post 5, a cross-section of the former in a horizontal direction is smaller, and therefore the solder posts 5 are arranged more densely on the insulating body 1.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, provided with a plurality of accommodating holes vertically running through the insulating body;

a plurality of terminals, respectively and correspondingly accommodated in the accommodating holes, wherein each of the terminals has a main body portion, a contact portion extending upward from the main body portion, and a soldering portion extending downward from the main body portion, the soldering portion has at least one clamping portion, and the at least one clamping portion forms a clamping space; and a plurality of solder posts, each being correspondingly placed in the clamping space of a corresponding one of the terminals, wherein each of the solder posts has a foundation post and a protruding portion extending upward from the foundation post, the at least one clamping portion clamps the foundation post in the clamping space, a width of the protruding portion is smaller than a width of the foundation post, the protruding portion is higher than the clamping portion, the foundation post is cylindrical, and a height of each of the solder posts is greater than a diameter of the foundation post.

2. The electrical connector according to claim 1, wherein the soldering portion has a connecting portion, two clamping portions are formed by extending respectively and symmetrically from two sides of the connecting portion, the connecting portion and the two clamping portions jointly form the clamping space, the two clamping portions clamp the foundation post, and the connecting portion abuts the foundation post.

3. The electrical connector according to claim 2, wherein the connecting portion is vertically disposed.

4. The electrical connector according to claim 2, wherein a side of the clamping space away from the connecting portion is provided with an opening, and the opening is located between the two clamping portions and separates the two clamping portions.

5. The electrical connector according to claim 1, wherein an outer side of the solder post is arc-shaped, an inner wall of the clamping space is correspondingly arc-shaped, and the solder post is in laminated contact with the inner wall of the clamping space.

6. The electrical connector according to claim 1, wherein the protruding portion is provided to gradually shrink upward from the foundation post.

7. The electrical connector according to claim 1, wherein a horizontal cross-section of the protruding portion is circular-shaped.

8. The electrical connector according to claim 1, wherein a top of the protruding portion is an arc surface.

9. The electrical connector according to claim 1, wherein the foundation post has a bottom surface horizontally disposed and extending downward beyond the accommodating hole, and the bottom surface is configured to be in contact with a circuit board.

10. The electrical connector according to claim 9, wherein a distance between the bottom surface and the at least one clamping portion is greater than 0.15 cm.

11. The electrical connector according to claim 1, wherein a siphon-proof structure is provided at a position of the main body portion close to the soldering portion.

12. The electrical connector according to claim 11, wherein the siphon-proof structure is at least partially lower than the protruding portion.

13. The electrical connector according to claim 1, wherein a stopping portion is disposed in the accommodating hole, and the stopping portion is located above the protruding portion.

14. The electrical connector according to claim 1, wherein the solder post is made of tin.

* * * * *